US009956816B2

(12) United States Patent
Lacy

(10) Patent No.: US 9,956,816 B2
(45) Date of Patent: May 1, 2018

(54) PAINT STORAGE AND APPLICATION APPARATUS AND METHOD OF USE

(71) Applicant: Mark Lacy, Houston, TX (US)

(72) Inventor: Mark Lacy, Houston, TX (US)

(73) Assignee: My Paint Saint, LLC, Houston, TX (US)

( * ) Notice: Subject to any disclaimer, the term of this patent is extended or adjusted under 35 U.S.C. 154(b) by 127 days.

(21) Appl. No.: 14/856,765

(22) Filed: Sep. 17, 2015

(65) Prior Publication Data

US 2016/0075174 A1 Mar. 17, 2016

Related U.S. Application Data

(60) Provisional application No. 62/051,357, filed on Sep. 17, 2014.

(51) Int. Cl.

| | |
|---|---|
| ***A46B 11/00*** | (2006.01) |
| ***B44D 3/12*** | (2006.01) |
| ***A46B 15/00*** | (2006.01) |

(52) U.S. Cl.

CPC ..... *B44D 3/121* (2013.01); *A46B 15/0095* (2013.01); *B44D 3/127* (2013.01); *A46B 2200/202* (2013.01)

(58) Field of Classification Search

CPC .... A44D 3/121; B65D 39/08; A46B 15/0095; A46B 15/00; B44D 3/121; B44D 3/127

USPC ..... 401/120–135

See application file for complete search history.

(56) References Cited

U.S. PATENT DOCUMENTS

| | | | | | |
|---|---|---|---|---|---|
| 1,959,441 | A * | 5/1934 | Oscar | A46B 17/00 | 15/248.1 |
| 2,627,276 | A * | 2/1953 | Eggleton | G04D 3/083 | 134/143 |
| 2,654,504 | A * | 10/1953 | Hyams | B44D 3/125 | 206/209 |
| 3,085,583 | A * | 4/1963 | Siek | B44D 3/24 | 134/109 |
| 3,955,670 | A | 5/1976 | Buslik | | |
| 4,533,044 | A | 8/1985 | Ban | | |
| 4,865,188 | A * | 9/1989 | Custeau | B44D 3/006 | 134/201 |
| 5,007,553 | A | 4/1991 | Curtis | | |
| 5,540,363 | A * | 7/1996 | Wilson | B44D 3/125 | 206/15.3 |
| 5,709,313 | A * | 1/1998 | Richoux | B65D 39/088 | 220/601 |
| 5,909,820 | A * | 6/1999 | Yeh | A47J 41/0016 | 215/356 |
| 5,971,189 | A * | 10/1999 | Baughman | B65D 39/084 | 220/288 |
| 5,992,617 | A * | 11/1999 | Couch | B44D 3/125 | 206/15.2 |
| 6,041,919 | A * | 3/2000 | Adams | A45D 34/046 | 206/15.2 |
| 6,213,329 | B1 * | 4/2001 | Dobson | A46B 11/0079 | 206/15.2 |

(Continued)

*Primary Examiner* — Jennifer C Chang

(74) *Attorney, Agent, or Firm* — Bushman Werner, P.C.

(57) ABSTRACT

A paint storage and usage system including a container and a cap. The container has at least one internal ledge for removing excess paint. The cap includes a handle and a paint brush. The cap is affixed to the container by a threaded ring which engages threads on the container and compresses the cap against the top of the container.

12 Claims, 6 Drawing Sheets

(56) References Cited

U.S. PATENT DOCUMENTS 6,446,829 B1 * 9/2002 Malvasio ..... B44D 3/123 220/697
6,494,315 B2 * 12/2002 Frisk ..... B44D 3/123 206/15.3
7,040,828 B2 5/2006 LaPointe
7,137,525 B2 11/2006 Gibney
7,287,662 B2 * 10/2007 Van De Klippe .... B65D 39/084 220/254.8
7,703,641 B2 4/2010 Bravo et al.
7,980,403 B2 * 7/2011 Martinez ..... B65D 39/08 215/356
2002/0011498 A1 * 1/2002 Giblin ..... B65D 47/06 222/109
2002/0195471 A1 * 12/2002 Nottingham ..... B01F 15/00733 222/570
2003/0168465 A1 * 9/2003 Breimon ..... B65D 21/022 220/783
2004/0175224 A1 * 9/2004 Hermansen ..... A45D 34/045 401/126
2006/0021995 A1 * 2/2006 Lavin ..... B44D 3/12 222/105
2006/0151422 A1 * 7/2006 Manley ..... B65D 39/08 215/341
2007/0045132 A1 3/2007 Anderson
2009/0250426 A1 * 10/2009 Martinez ..... B65D 39/16 215/356
2010/0310297 A1 * 12/2010 Gueret ..... A01N 59/16 401/129
2011/0036845 A1 * 2/2011 Nielsen ..... B44D 3/12 220/495.01
2012/0193358 A1 * 8/2012 Billado, Jr. ..... B65D 43/02 220/212
2012/0199599 A1 * 8/2012 Minnette ..... B65D 43/0212 220/780
2012/0301207 A1 * 11/2012 Kriesel ..... B05C 17/00 401/129
2012/0315076 A1 * 12/2012 Bekele ..... A61K 8/375 401/129
2014/0175104 A1 * 6/2014 Leonard ..... B44D 3/127 220/735
2014/0326735 A1 * 11/2014 Minnette ..... A47G 19/02 220/574

* cited by examiner 40
80
10
20

40
10
20
80

40
41
42
43
44
45
46
47
48
35
3B

PAINT STORAGE AND APPLICATION APPARATUS AND METHOD OF USE

CROSS REFERENCE TO RELATED APPLICATION

This application claims priority to U.S. Application No. 62/057,357 filed on Sep. 17, 2014 the disclosure of which is incorporated herein by reference for all purposes.

FIELD OF THE INVENTION

The present invention relates generally to an apparatus for storing paint and more particularly to an apparatus for storing and applying paint for touch-ups.

BACKGROUND OF THE INVENTION

It is not uncommon for a painted surface to require touch-ups due to stains, scratches, repairs, etc. Such touch-ups are not always small or minor. For example, hotels are subject to quality inspections and frequently must touch up and repair scratches and stains on the paint of numerous hotel rooms. In general, touching up a painted surface requires procuring the correct color of paint, opening the paint can, pouring it into an appropriate container, carrying the container to the appropriate area and applying the paint with a brush. Afterwards, the brush must be cleaned and the excess paint returned to the can or disposed of. The process can be time consuming and messy.

Alternatively, there are products which reduce the number of steps required to touch up painted surfaces. One such product, sold under the name Qwikie, comprises a container in which paint is stored. A small brush is attached to the lid of the container. The brush of this tool is small, limiting touch ups to a small area. Furthermore, the lid of the container is generally dome-shaped and does not serve as a good hand-held painting tool.

Other products utilize a paint roller connected to a hand-held paint storage apparatus. Such devices have several disadvantages including the inability to control the amount of paint on the roller, no way to prevent dripping, dried out rollers, the need to clean and/or replace the rollers, small rollers which only allow for small touchups, small amount of paint stored in the apparatus, and a container shape which does not stand on its own and must thus be laid on its side leading to potential paint leaks. Some examples of such products are the Paint Buddy sold by Rubbermaid; the Shur-Line Touchup painter; and the Paint Touchup Tool Roller & Bottle by Woolie.

The disadvantages of the prior art are overcome by the present invention, and an improved paint storage and touch up apparatus is hereinafter disclosed.

SUMMARY OF THE INVENTION

In one aspect, the present invention provides an apparatus for the storage of excess paint.

In another aspect, the present invention provides an apparatus for the storage of excess paint and the application of paint touch ups.

In still another aspect, the present invention provides a method of touching up painted surfaces.

These and further features and advantages of the present invention will become apparent from the following detailed description, wherein reference is made to the figures in the accompanying drawings.

DETAILED DESCRIPTION OF PREFERRED EMBODIMENTS

Figure 1:
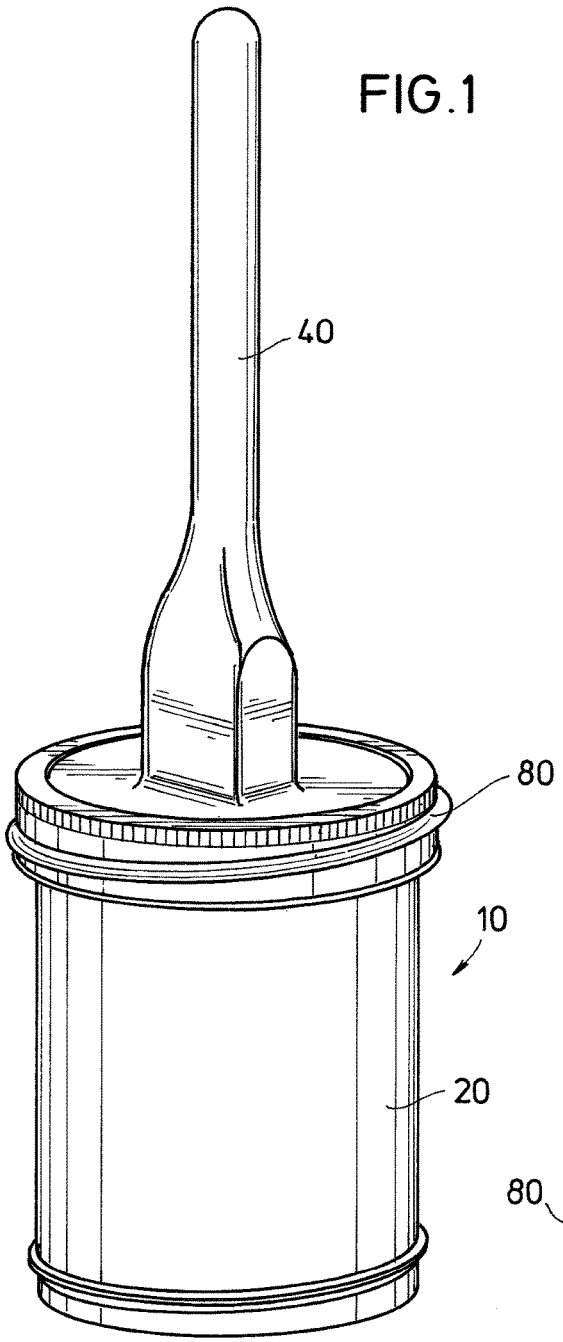
FIG. 1 is a photo of one embodiment the apparatus of the present invention.

With respect to FIG. 1 there is shown the apparatus of the present invention, shown generally as 10. The apparatus is generally comprised of a container 20, a handle 40, a closing ring or band 80, and a painting tool or implement such as brush B (see FIG. 5B). As will be explained more fully hereafter, closing ring 80 is an internally threaded ring which holds handle 40 and container 20 together during storage.

Figure 2B:
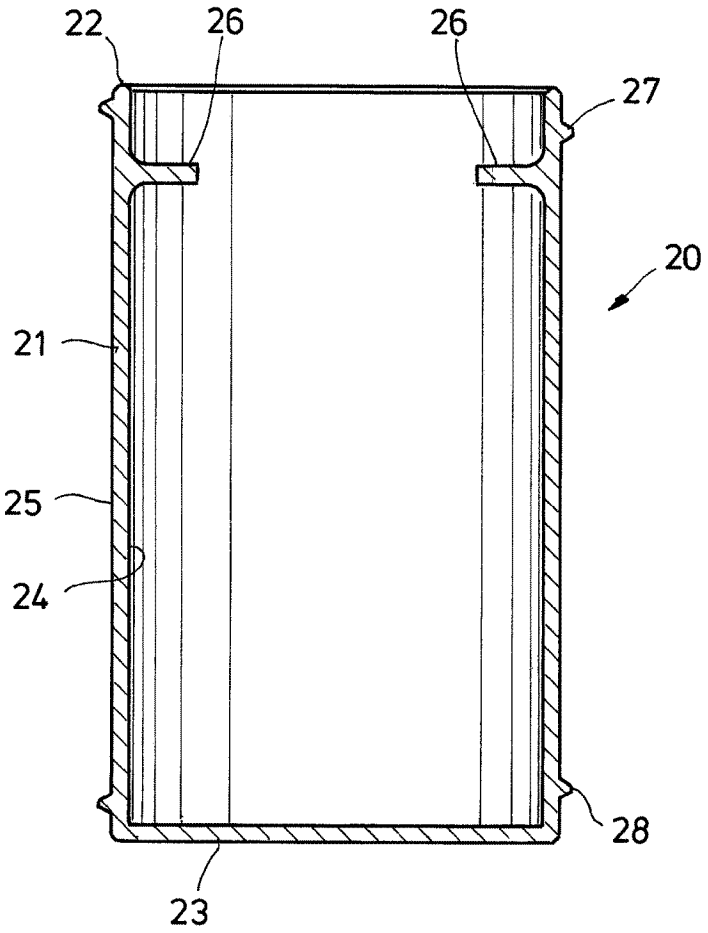
FIG. 2B is a cross-sectional view taken along the line 2B-2B of FIG. 2A.
Figure 2A:
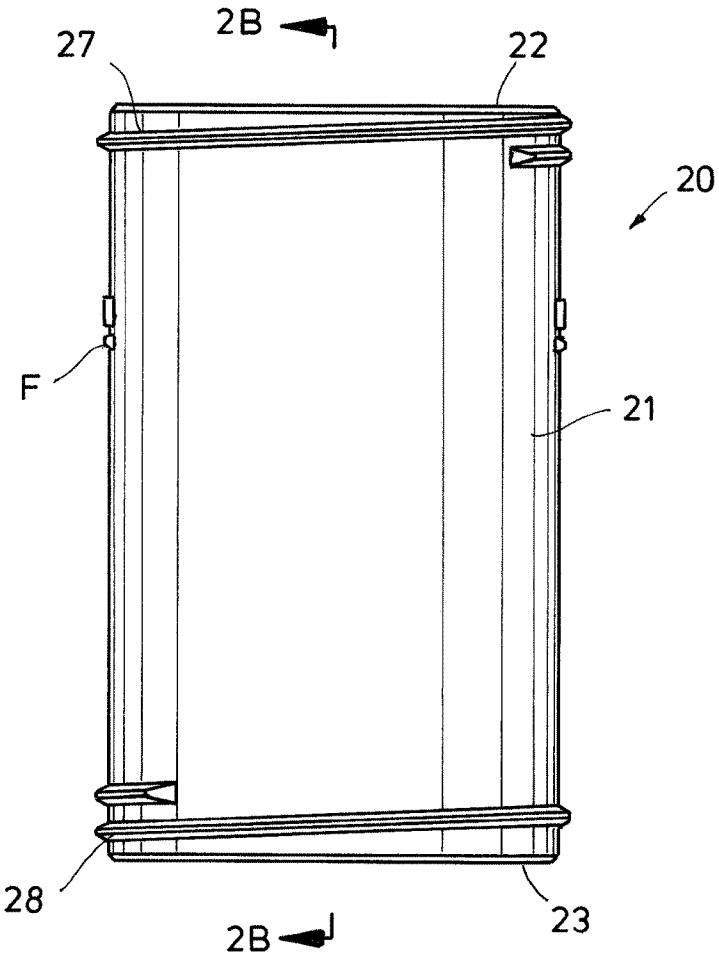
FIG. 2A is an elevational view of the container of the present invention.

As best seen in FIGS. 2A-2B, the container 20 is comprised of a cylindrical wall 21 having an upper end 22, a bottom wall 23, an inner surface 24, and an outer surface 25. Inner surface 24 has at least one inwardly extending ledge 26 proximal upper end 22. It will be understood that the number of ledges 26 can vary between embodiments and may include a single annular ledge 26 along the entire inner surface 24. In a preferred embodiment, container 20 has two inwardly extending ledges 26 disposed opposite one another. Outer surface 25 has first external threads 27 proximal upper end 22 and second external threads 28 proximal bottom wall 23. The purpose of ledges 26 and threads 27, 28 will be explained hereafter. In a preferred embodiment, outer surface 25 includes a maximum fill line F delineating the maximum amount of paint to be stored in container 20.

Figures 3A, 3B, 3C:
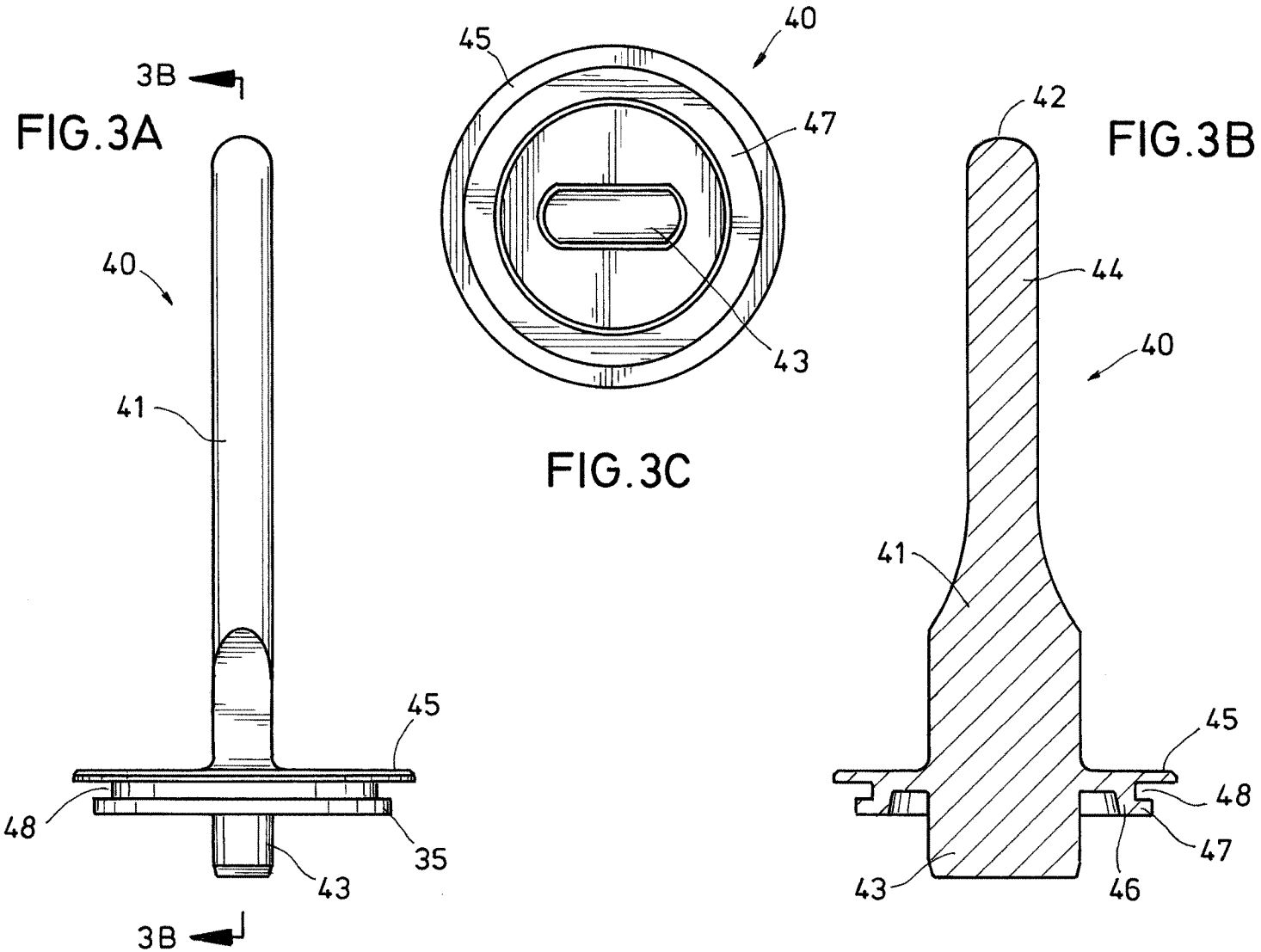
FIG. 3A is an elevational side view of the handle/cap of the present invention.
FIG. 3B is a cross-sectional view taken along the line 3B-3B of FIG. 3A.
FIG. 3C is a bottom view of the handle/cap of the apparatus of the present invention.

Turning to FIGS. 3A-3C, there is shown the handle/cap seal assembly 40 of the invention, also referred to as handle 40. Handle 40 comprises elongate body 41 having a first end 42 and a second end 43. Body 41 is tapered in at least one dimension toward first end 42 to form grip portion 44. Disposed proximal second end 43 is a cap 45. In a preferred embodiment, annular rim 46 extends axially from cap 45 toward second end 43. Annular rim 46 has an annular, radially outwardly extending lip 47. The axial recess 48 formed between cap 45 and lip 47 is sized to receive a gasket 50 as shown in FIGS. 5B and 5D.

In a preferred embodiment, handle 40 and rim 45 are monolithically formed, but it will be understood that they can be separate pieces affixed to one another by means well known to those of skill in the art.

Figure 4A:
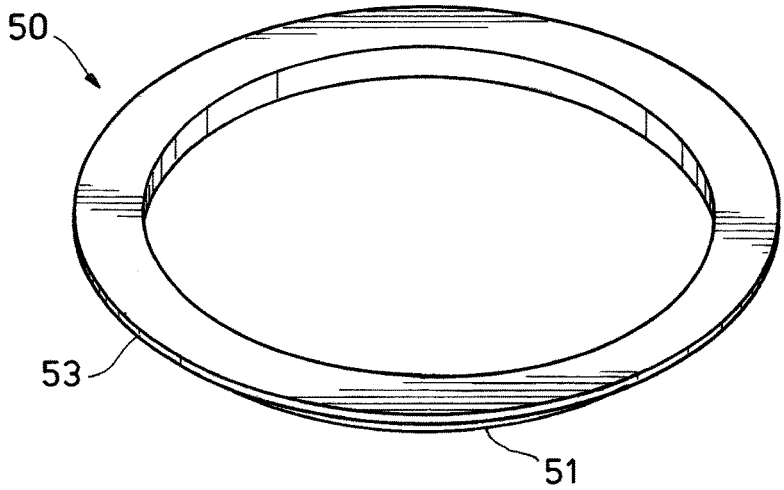
FIG. 4A is an isometric view of the gasket of the present invention.
Figure 4B:
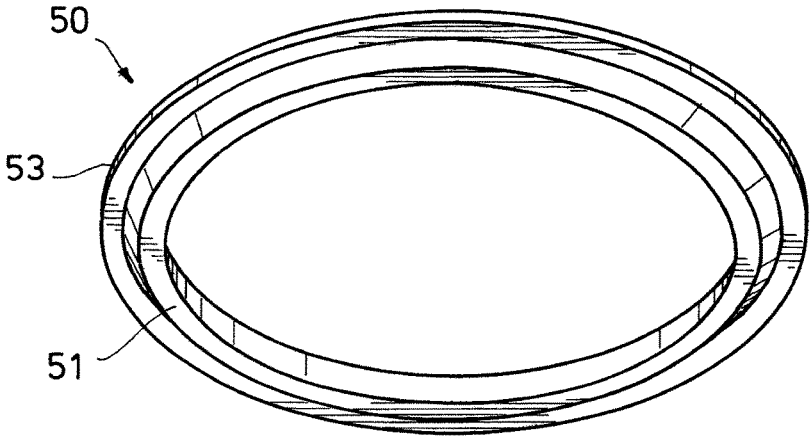
FIG. 4B is an isometric view of the lower side of the gasket of the present invention.
Figure 4C:
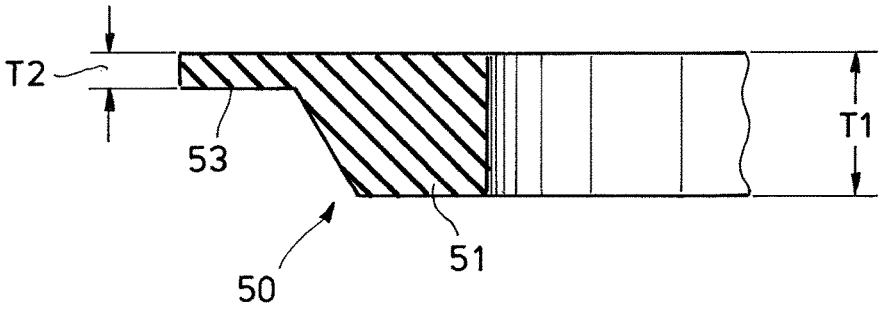
FIG. 4C is a cross-sectional view of the gasket shown in FIG. 4A.

Turning to FIGS. 4A-4C there is shown gasket 50. In a preferred embodiment, gasket 50 will be formed of silicone, though it could be formed of any material appropriate for forming a seal. As best seen in FIG. 4C, gasket 50 has an annular body 51 of a first thickness T1 and an annular, outwardly extending lip 53 having a second, smaller thickness T2.

Figure 5A:
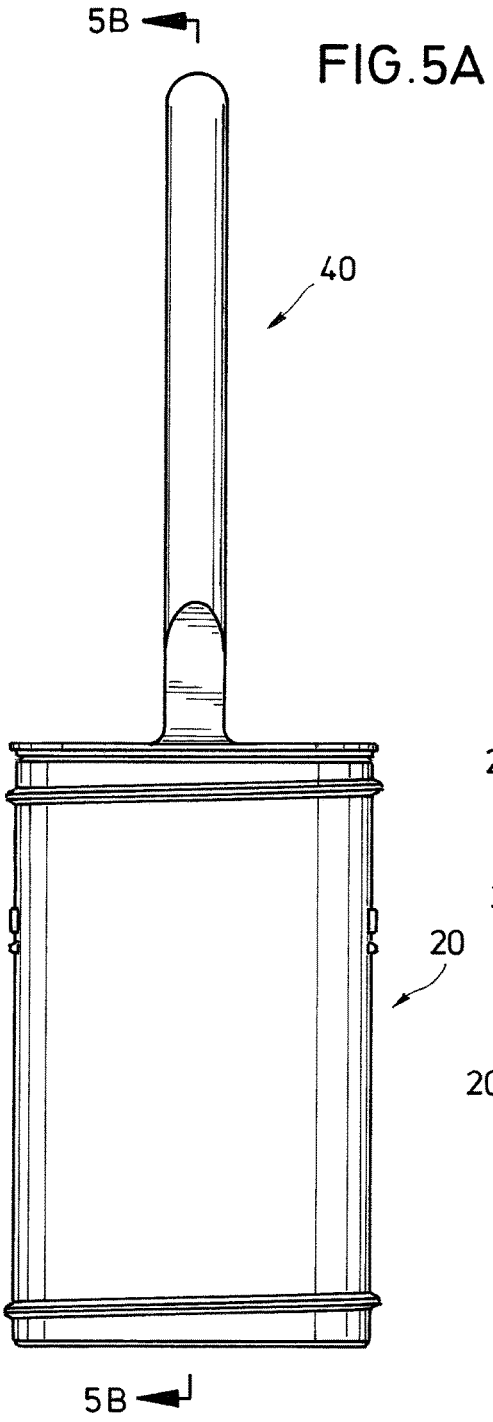
FIG. 5A is an elevational side view of the container and handle/cap of the present invention.
Figure 5B:
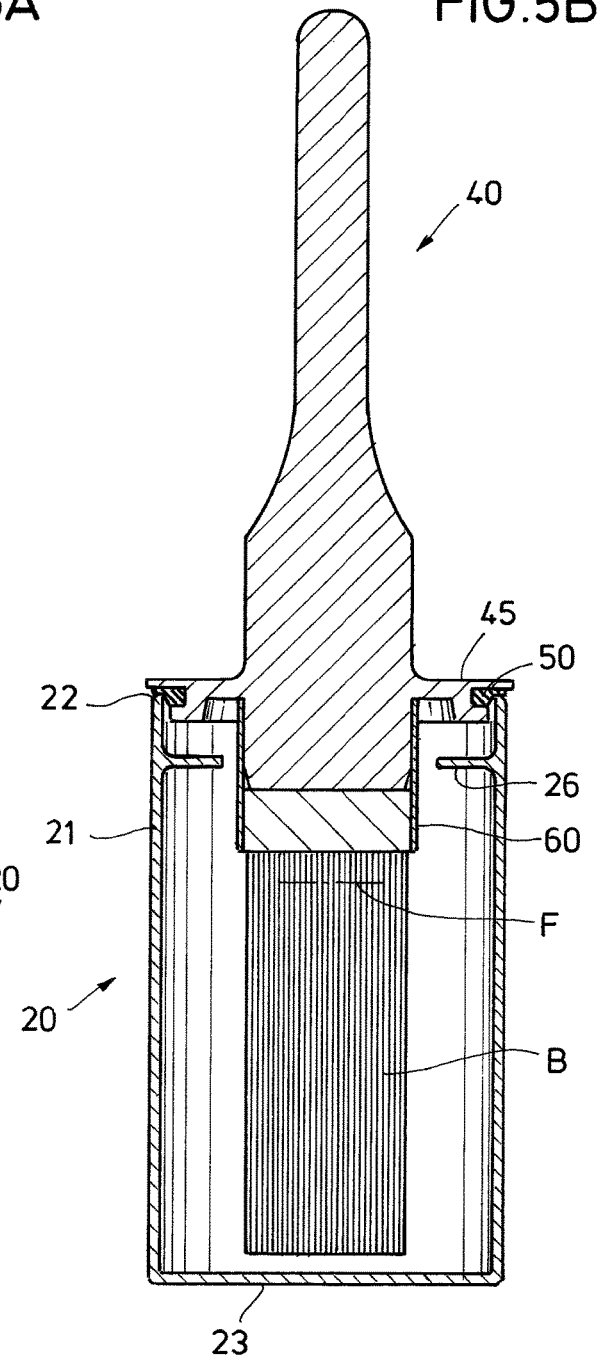
FIG. 5B is a cross-sectional view taken along the line 5B-5B of FIG. 5A.
Figure 5C:
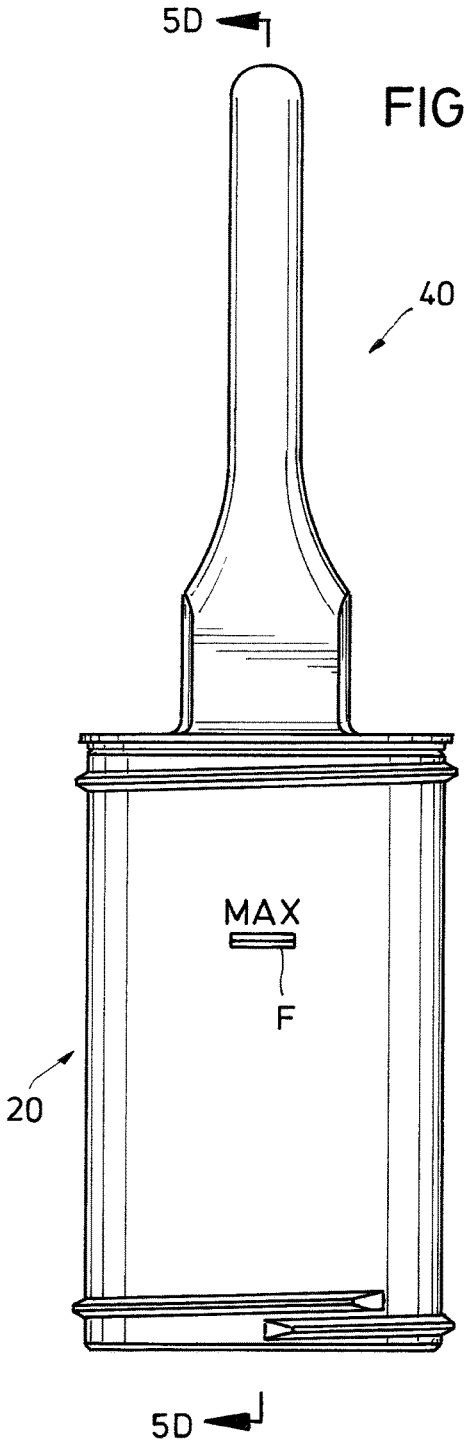
FIG. 5C is an elevational front view of the apparatus of the present invention.
Figure 5D:
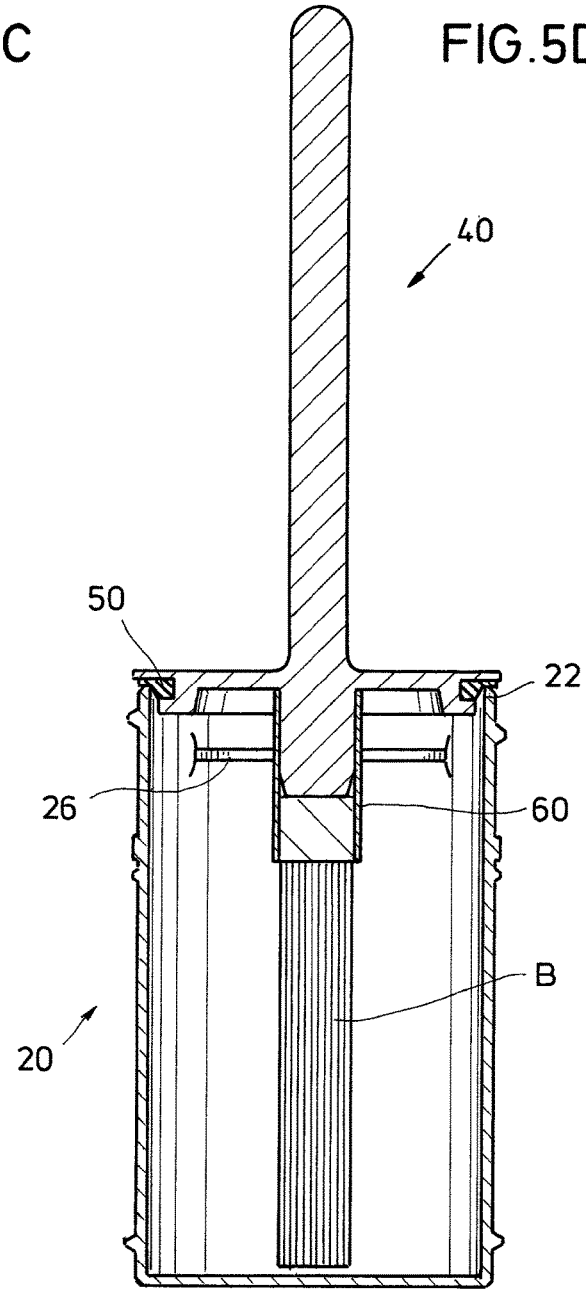
FIG. 5D is a cross-sectional view taken along the line 5D-5D of FIG. 5C.

Turning to FIGS. 5A-5D, there is shown handle 40 disposed within container 20. It is best seen in FIGS. 5B and 5D that rim 45 of handle 40 overlies the upper end 22 of container 20. Gasket 50, in recess 48, engages upper end 22 to form an air tight seal of container 20. Brush B is shown secured to the second end 43 of handle 40 by ferrule 60. As shown ferrule 60 grips both the second end 43 of handle 40 and the bristles of brush B. It will be understood that brush B can be secured to handle 40 by any means well known to those skilled in the art. The position of maximum fill line F is shown in FIG. 5B to illustrate that the maximum fill line is beneath ferrule 60, thus ensuring the brush B is within the paint, but the ferrule 60 and handle 40 remain above the paint, even when container 20 is filled to the maximum fill line F.

Figure 6:
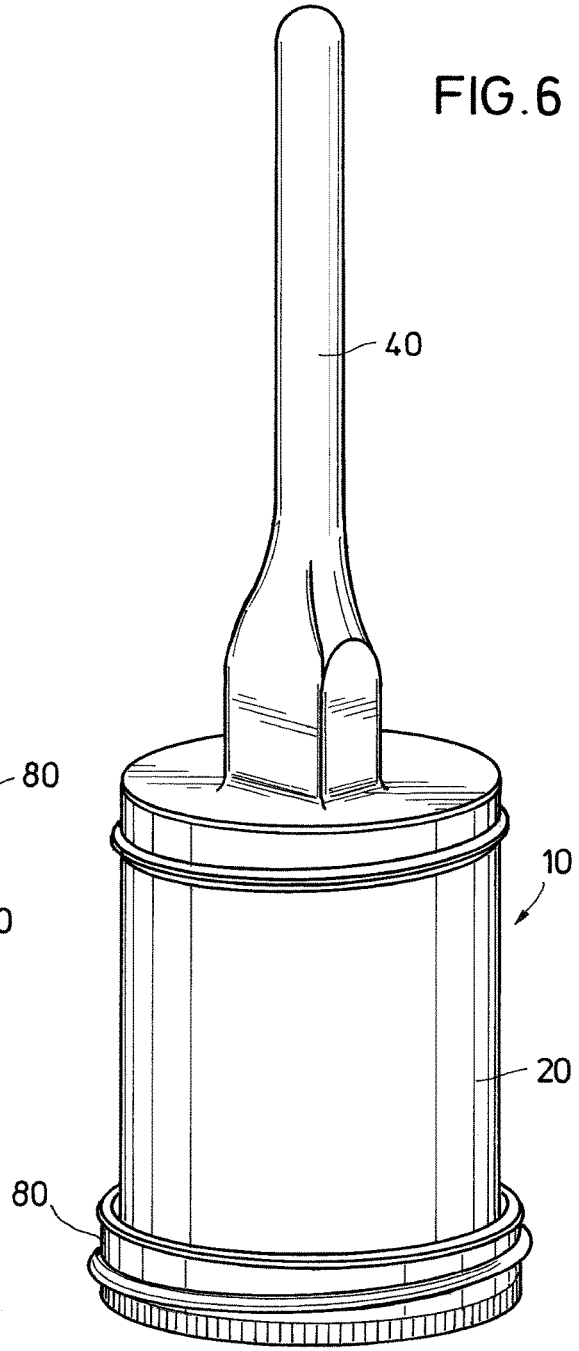
FIG. 6 is a photo of the apparatus of the present invention.

As set forth above, closing ring 80 is an internally threaded ring which holds handle 40 and container 20 together during storage (see FIG. 1). Closing ring 80 is threaded internally and engages with first external threads 27 to force gasket 50 into contact with upper end 22 of container 20 and to prevent handle 40 from being pulled from container 20 without first removing closing ring 80. During use, closing ring 80 can be threaded to second external threads 28 (see FIG. 6). Second external threads 80 thus provide a convenient storage location for closing ring 80 and ensure it is not misplaced during use.

The apparatus of the present invention has several advantages over the prior art paint touch up devices. After finishing a painting project, excess paint is poured into container 20 to a level no higher than maximum fill line F. Handle/cap seal 40, with brush B attached is placed in container 20. Closing ring 80 is placed over handle 40 and threaded to first external threads 27 to hold handle 40 in place and form a seal until the paint is needed. When the paint is needed again, closing ring 80 is unthreaded from the first external threads 27 and, if desired, threaded to second external threads 28 of container 20 for storage/safekeeping while painting. If needed, the paint is stirred using brush B. Handle 40 is then used to ensure paint is on brush B. Excess paint is removed by sliding brush B along ledges 26 of container 20. The paint can then be applied by brush B as needed. The cap seal and, in particular annular rim 46, also provide a drip guard to protect the painter's hand. Should paint run down the brush toward the handle during use, the cap and the annular rim prevent the paint from reaching the user's hands. After use, brush B is returned to container 20 and container 20 is resealed using closing ring 80. The paint in container 20 need not be transferred to another container prior to touch ups. Ledges 26 within container 20 provide a means for removing excess paint from brush B, without dripping any paint outside the container 20. Closing ring 80, and preferably gasket 50, ensures the paint stays in the container and prevents drying out of the brush. The brush B is reusable and there is no need to clean the brush B between touchups.

It will be appreciated that while the description above and the drawings set forth the preferred embodiment of the invention, alternative embodiments may be within the scope of the invention. The apparatus of the present invention can be used with materials other than paint. For example, rather than brush B, a spackle knife can be attached to handle 40 and putty/spackle or the like can be stored in container 20.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A paint storage and usage system, comprising:

a container comprising a peripheral wall, an upper end, and a bottom wall, said peripheral wall having an inner surface and an outer surface;

at least one laterally inwardly extending ledge disposed on said inner surface of said peripheral wall;

first external threads disposed on said outer surface of said peripheral wall proximate said upper end;

a handle comprising an elongate body having a first end and a second end;

a cap proximate said second end of said body, said cap having an upper surface and a lower surface;

a painting implement attached to said second end of said body; and a removable internally threaded ring operative to be placed over said handle and selectively engage said external threads to compress said lower surface of said cap against said upper end of said container.

2. The system of claim 1, further comprising:

an annular seal assembly axially projecting from said lower surface of said cap.

3. The system of claim 2, wherein said seal assembly comprises a rim axially projecting from said lower surface of said cap and having a radially outwardly extending lip, a radially outwardly facing annular recess being formed between said lip and said cap, and a gasket being positioned in said annular recess.

4. The system of claim 1, comprising a plurality of laterally inwardly extending ledges circumferentially spaced along said inner surface of said peripheral wall.

5. The system of claim 1, further comprising:

second external threads disposed on said outer surface of said peripheral wall proximate said bottom wall.

6. The system of claim 5, wherein said internally threaded ring is threadedly engageable with said second external threads proximate said bottom wall.

7. The system of claim 1, wherein said painting implement comprises a brush.

8. The apparatus of claim 1, wherein said elongate body is tapered to form a grip.

9. The system of claim 1, wherein said second end of said body extends below said lower surface of said cap, and said handle and said cap are monolithic.

10. The system of claim 1, wherein said container is generally cylindrical.

11. A paint storage and usage system, comprising:

a container comprising a peripheral wall, an upper end, and a bottom wall, said peripheral wall having an inner surface and an outer surface;

first external threads disposed on said outer surface of said peripheral wall proximate said upper end;

a handle comprising an elongate body having a first end and a second end;

a cap proximate said second end of said body, said cap having an upper surface and a lower surface, an annular seal assembly axially projecting from said lower surface of said cap, said seal assembly comprises a rim axially projecting from said lower surface of said cap and having a radially outwardly extending lip, a radially outwardly facing annular recess being formed between said lip and said cap, and a gasket being positioned in said annular recess;

a painting implement attached to said second end of said body; and a removable internally threaded ring operative to be positioned over said handle and selectively engage said external threads to compress said gasket against said upper end of said container.

12. A paint storage and usage system, comprising:

a container comprising a peripheral wall, an upper end, and a bottom wall, said peripheral wall having an inner surface and an outer surface;

at least one laterally inwardly extending ledge disposed on said inner surface of said peripheral wall;

first external threads disposed on said outer surface of said peripheral wall proximate said upper end;

second external threads disposed on said outer surface of said peripheral wall proximate said bottom wall;

a handle comprising an elongate body having a first end and a second end;

a cap proximate said second end of said body, said cap having an upper surface and a lower surface, said second end of said body extending below said lower surface of said cap;

a painting implement attached to said second end of said body; and a removable internally threaded ring operative to be positioned over said handle and selectively engage said first external threads to compress said lower surface of said cap against said upper end of said container, and operative to selectively engage said second external threads to be stored during painting with said painting implement.

* * * * *